US007574783B2

(12) United States Patent
Muratsubaki et al.

(10) Patent No.: US 7,574,783 B2
(45) Date of Patent: Aug. 18, 2009

(54) PULL TAB OF SLIDE FASTENER SLIDER

(75) Inventors: Koji Muratsubaki, Kurobe (JP); Atsushi Arai, New Delhi (IN); Kinzo Osumi, Ota (JP)

(73) Assignees: YKK Corporation, Tokyo (JP); Iris Co., Ltd., Gunma-Ken (JP)

( * ) Notice: Subject to any disclaimer, the term of this patent is extended or adjusted under 35 U.S.C. 154(b) by 174 days.

(21) Appl. No.: 10/919,677

(22) Filed: Aug. 16, 2004

(65) Prior Publication Data

US 2005/0050698 A1 Mar. 10, 2005

(30) Foreign Application Priority Data

Sep. 4, 2003 (JP) ..... 2003-313043

(51) Int. Cl.
*A44B 19/24* (2006.01)

(52) U.S. Cl. ..... 24/429

(58) Field of Classification Search ..... 24/429–431; 16/441, 422; 294/3.6
See application file for complete search history.

(56) References Cited

U.S. PATENT DOCUMENTS 4,193,172 A * 3/1980 Kanzaka ..... 24/704.1
4,368,562 A 1/1983 Minami
4,389,758 A 6/1983 Akashi
4,873,750 A 10/1989 Tracy
5,136,758 A * 8/1992 Wilcox et al. ..... 24/431
6,026,546 A * 2/2000 Lund et al. ..... 24/431
6,415,482 B1 * 7/2002 Pontaoe ..... 24/429
6,804,867 B2 * 10/2004 Oda et al. ..... 24/429
2002/0069494 A1 6/2002 McCrum
2004/0148745 A1 * 8/2004 Moeller et al. ..... 24/429

FOREIGN PATENT DOCUMENTS

DE 2803559 A * 8/1979
FR 1 404 564 A 7/1965
FR 2453614 A * 12/1980
JP 3085546 2/2002
WO WO 8002494 A * 11/1980

* cited by examiner

*Primary Examiner*—James R Brittain
(74) *Attorney, Agent, or Firm*—Alston & Bird LLP

(57) ABSTRACT

A pull tab of a slide fastener slider comprises a pull tab proper having a insert portion and a slider-attaching portion provided at a proximal end of the insert portion for attachment to the slider; and a cover made of flexible material and adapted to have the insert portion inserted thereinto. The insert portion includes a plurality of locking surface features for preventing the cover from being pulled off the insert portion.

6 Claims, 19 Drawing Sheets

PULL TAB OF SLIDE FASTENER SLIDER

CROSS-REFERENCE TO RELATED APPLICATIONS

The entire disclosure of Japanese patent application number 2003-313043 filed on Sep. 4, 2003 is incorporated herein by reference in its entirety.

BACKGROUND OF THE INVENTION

1. Field of the Invention

This invention relates to a pull tab of a slide fastener slider, and specifically to a pull tab which is comprised of a pull tab proper and a cover to cover the pull tab proper.

2. Description of the Related Art

Heretofore, there have been proposed pull tabs coated with flexible and resilient materials or having such materials connected to its end in order to make the pull tab as a whole feel good or agreeable to the touch when the user grips the pull tab.

One example of this type of pull tabs is shown in U.S. Pat. No. 4,873,750 and is conveniently reproduced here in FIG. 33. The pull tab 100 of this U.S. patent comprises a pull tab proper 102 and an attachment 104 functioning as a cover. The pull tab proper 102 has a locking hole 106 formed at the distal end thereof and a locking projection 108 formed beside the locking hole 106. The attachment 104 is comprised of an attachment body 110 and a U-shaped clip 114. The attachment body 110 is molded from polyurethane, silicon rubber, thermoplastic elastomer, and has a channel 112 formed longitudinally thereof. The U-shaped clip 114 has its bottom end embedded in the channel 112 of the attachment body 110 and has a locking tongue 118 directed inwardly of the channel 112. When the pull tab proper 102 is inserted through an orifice 116 into the channel 112, either the locking hole 106 or the locking projection 108 comes into locking engagement with the locking tongue 118 so that the attachment 100 can be firmly attached to the pull tab proper 102.

Another example is shown in Japanese Utility Model Registration Publication No. 3085546 and is conveniently reproduced here in FIG. 34. The pull tab 200 of this Japanese publication is comprised of a pull tab proper 202 and a sheath 204 adapted to wrap around the pull tab proper 202. The pull tab proper 202 is of a cigar-like smooth rounded shape and has a thin front end, a thick middle part and a thin rear end, if named from left to right in FIG. 34. The sheath 204 is molded from polyurethane, silicon rubber, or thermoplastic elastomer. The pull tab proper 202 is covered with the sheath 204 to provide a pleasing touch.

The pull tab 100 shown in FIG. 33 is comprised of the pull tab proper 102 and the attachment 104 which in turn is comprised of the attachment body 110 and the clip 114. This means that production of the attachment 104 requires an extra step of assembling the clip 114 with the attachment body 110. Thus, the production of the attachment 104 and hence the pull tab 100 as a whole takes more labor and more time.

Since the pull tab proper 202 of the pull tab 200 shown in FIG. 34 has a cigar-like streamlined smooth rounded shape; during the manipulation of the pull tab 200, the flexible and resilient sheath 204 wrapped around the pull tab body 202 tends to slip off the pull tab body 202 at great ease.

With the above drawbacks in view, it is an object of this invention to provide a pull tab of a slide fastener slider which is comprised of a pull tab proper and a cover, wherein the pull tab proper is adapted to be inserted into the cover which is flexible and agreeable to the touch and wherein, once the pull tab proper is inserted into the cover, the cover can be retained on the pull tab body stably and formed for a prolonged period of term.

It is another object of this invention to provide a pull tab of a slide fastener slider wherein the pull tab proper has locking surface features or locking means by which the cover can be firmly locked to the pull tab proper against being pulled off or dislodged from the pull tabs or being rotated relative to the pull tab proper.

SUMMARY

In accordance with the present invention, a pull tab of a slide fastener slider, comprises: a pull tab proper 1 having a insert portion and a slider-attaching portion provided at a proximal end of the insert portion for attachment to the slider; and a cover made of flexible material and adapted to have the insert portion inserted thereinto the insert portion includes a plurality of locking surface features.

DRAWINGS-FIGURES

DRAWINGS-REFERENCE NUMBERS

Figure 1:
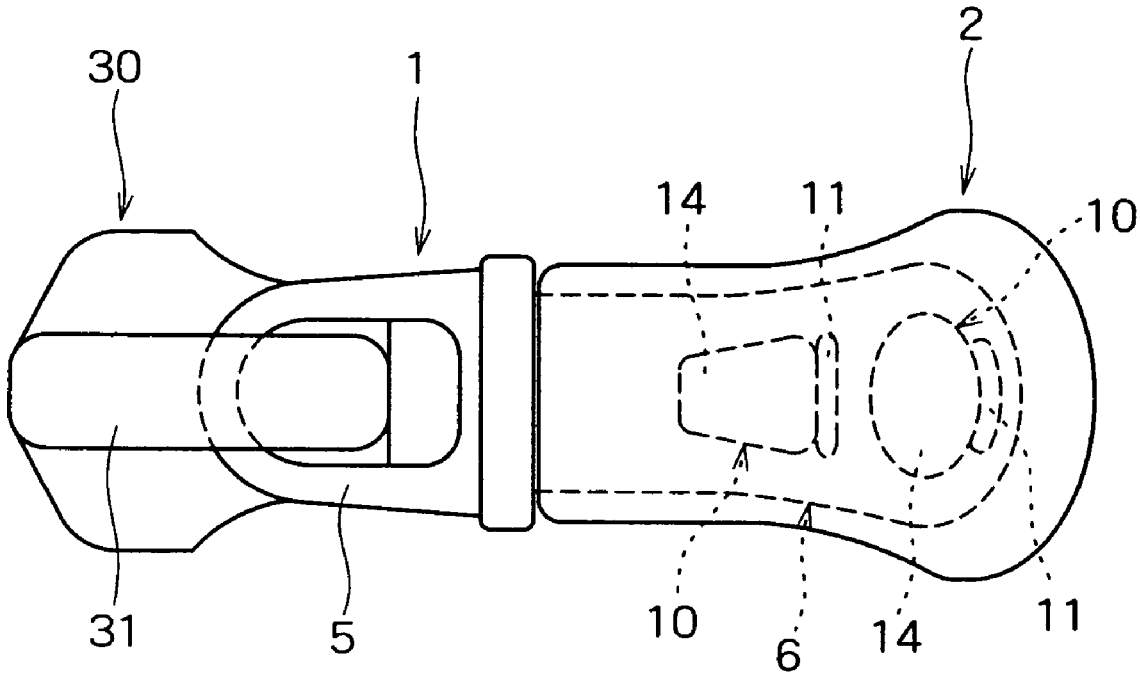
FIG. 1 is a front view of a slider for slide fasteners bearing a pull tab according to the first embodiment of the present invention.
Figure 2:
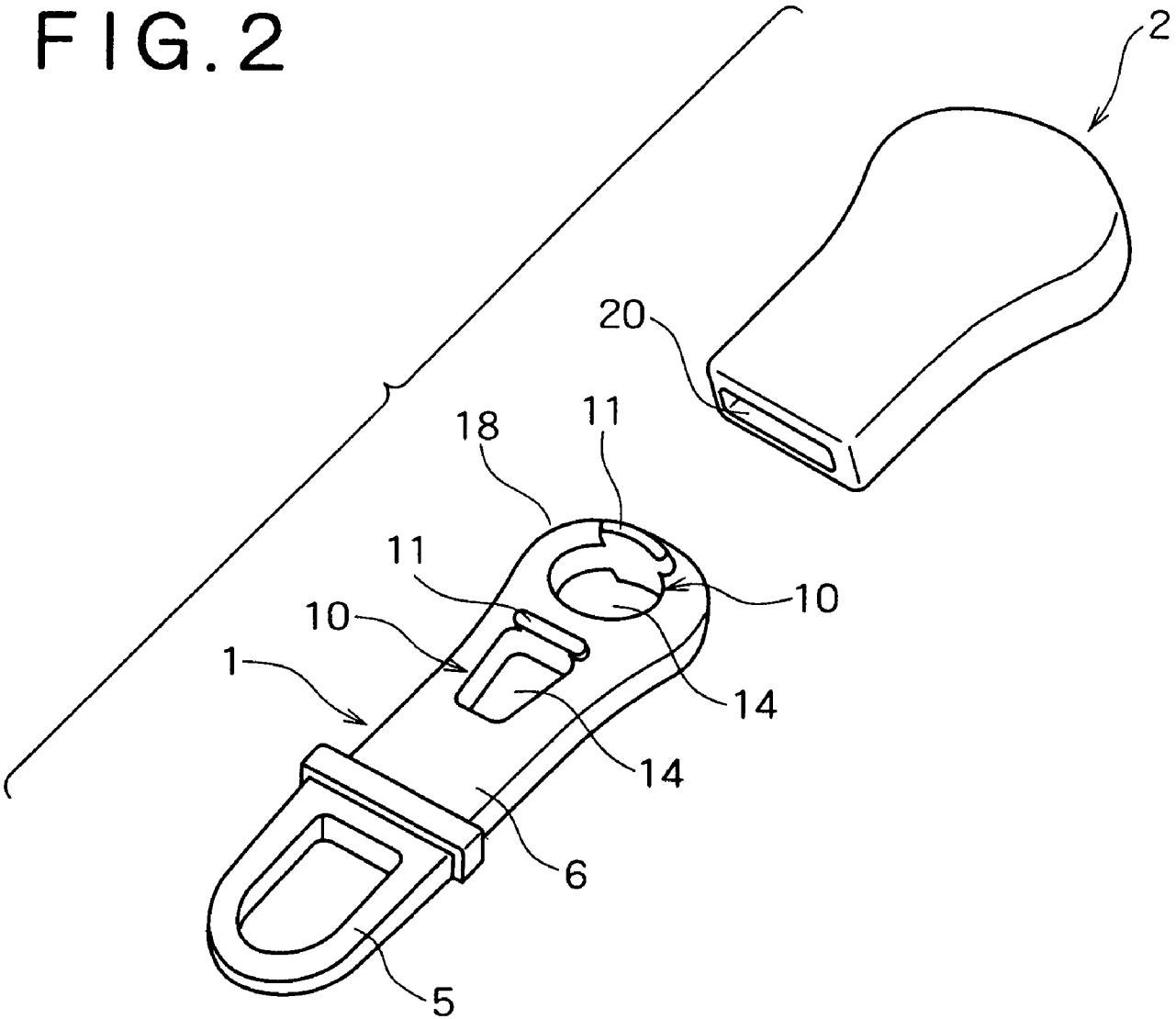
FIG. 2 is an exploded perspective view of the pull tab of FIG. 1.
Figure 3:
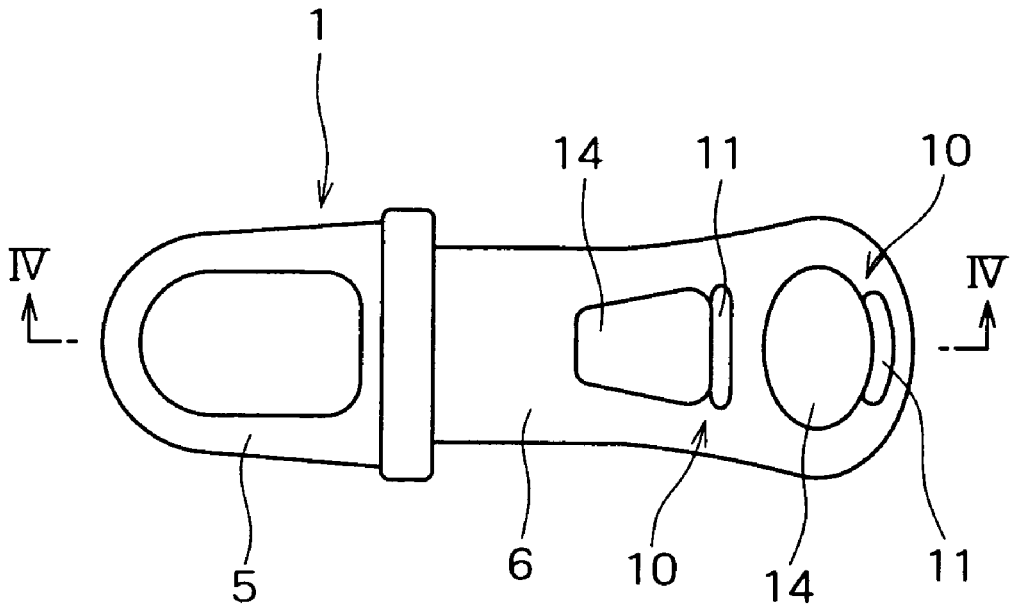
FIG. 3 is a front view of a pull tab proper of the pull tab of FIG. 1.
Figure 4:
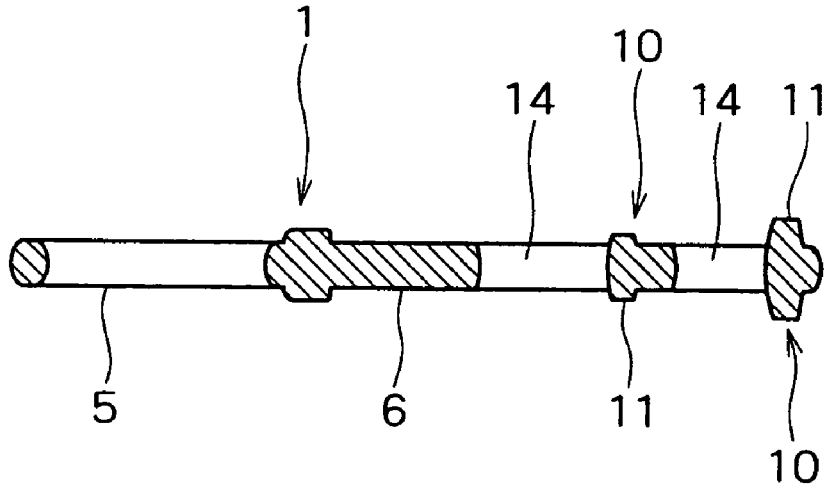
FIG. 4 is a cross-sectional view taken on line IV-IV of FIG. 3.

1 Pull tab proper
2 Cover
5 Attaching portion or attaching link
5' U-shaped clamper
6 Insert portion
10 Locking surface features
11 Projection
13 Serrate
14 Through hole
15 Recess
16 Notch or indentation
17 Projecting ridge or ridge
18 Arcuate flared portion
20 Orifice inlet, entrance
21 Locked surface features
22 Channel
22' Innermost part of channel
23 Protuberant engaging lug
30 Slider body
31 Pull-tab-attaching lug

DETAILED DESCRIPTION

Description is made below of some embodiments of a pull tab for a slide fastener slider according to the present invention in conjunction with drawings appended hereto.

As well seen from the drawings, a pull tab for a slide fastener slider according to the present invention is comprised of a pull tab proper 1 and a cover 2. The pull tab proper 1 is diecasted from metals such as aluminum alloy, zink alloy and the like. The pull tab proper 1 comprises an insert portion 6 and a slider-attaching portion or attaching link 5 provided at a proximal end of the insert portion 6 for attachment to a slider body 30. The insert portion 6 is provided with various locking surface features 10 such as projections 11, serrates 13, ridges or ridges 17, a flared portion 18, through holes 14, recesses 15, notches or indentations 16, and any combination of these locking surface features 10. The cover 2 is injection-molded from polyurethane, silicon rubber, thermoplastic elastomer or the like. The cover 2 has a channel 22 formed longitudinally thereof to house the insert portion 6 therein, and locked surface features 21 formed in the inner surface of the channel 22 and adapted for locking engagement with the locking surface features 10 on the insert portion 6. Alternatively some of the locking surface features 10 merely presses and bites into the inner surface of the channel 22, to thus firmly grasp the cover 2 and prevent the cover 2 from being pulled off or dislodged from the pull tab proper 1.

FIGS. 1 through 10 shows a pull tab of a slide fastener slider according to the first embodiment of this invention. As better shown in FIG. 2 through 4, the pull tab proper 1 comprises the insert portion 6 and the slider-attaching portion 5 provided on the proximal end of the insert portion 6. As shown in FIG. 1, the pull tab proper 1 is pivotally mounted on the slider body 30 by linking the slider-attaching portion 5 of the pull tab proper 1 to a pull-tab-attaching lug 31 mounted on the slider body 30. The insert portion 6 is an elongated flat piece and has a plurality of (two here) through holes 14 formed therethrough. The through holes 14 are aligned with and spaced from each other along the length of the insert portion 6. The two through holes 14 are different in their shapes, one which is close to the distal end of the insert portion 6 is oblong and the other which is remote therefrom is trapezoidal. Two elongate projections 11 are formed on each of the upper and lower side of the insert portion 6 and extend laterally of the length of the insert portion 6 along that edge of each through hole 14 which is closer to the distal end of the insert portion 6. The insert portion 6 is slightly spread or flared outwardly adjacent to its distal end and terminates in an arcuate end to thus provide an arcuate flared portion 18. In this embodiment, the two through holes 14, the four projections 11 and the arcuate flared or bulged portion 18 constitute the locking surface features 10 to lock the insert portion 6 to the cover 2 against being pulled thereoff when the insert portion 6 is fully inserted into the cover 2.

Figure 5:
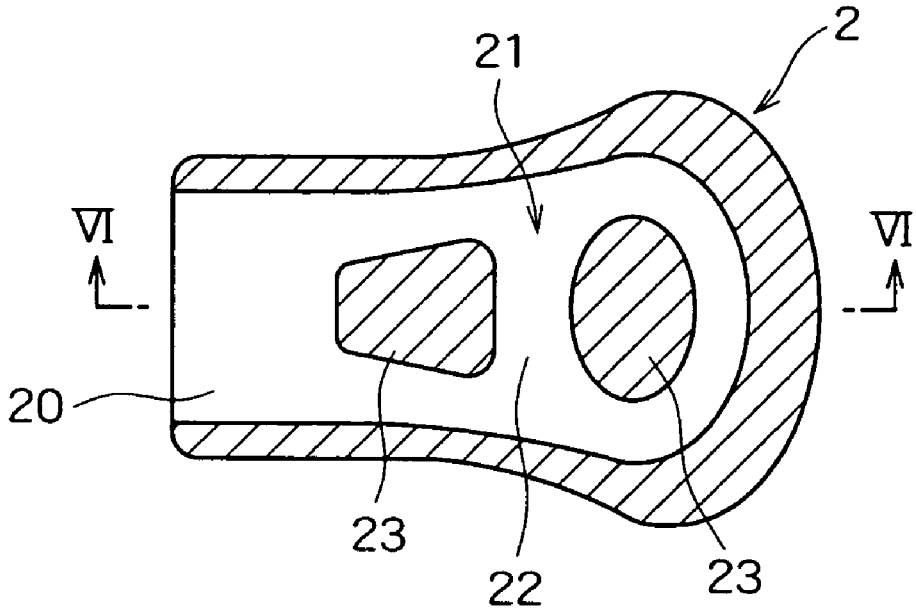
FIG. 5 is a cross-sectional view of a cover, taken on line V-V of FIG. 6.
Figure 6:
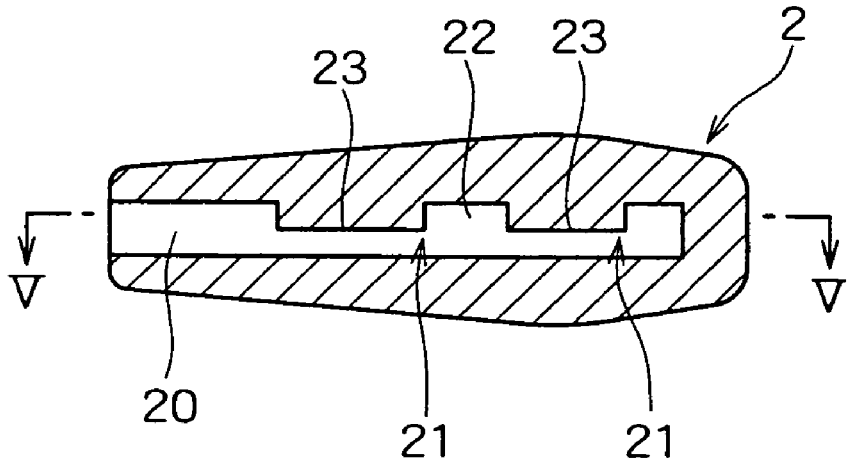
FIG. 6 is a cross-sectional view of the cover, taken on line VI-VI of FIG. 5.

As shown in FIGS. 5 and 6, the cover 2 has the channel 22 formed longitudinally of the cover 2, in order to permit the insert portion 6 to be inserted thereinto. The channel 22 is substantially complementary in shape with the insert portion 6 of the pull tab proper 1. Reference numeral 20 denotes an orifice or entrance formed at an open end of the channel 22, through which orifice the insert portion 6 is inserted into the channel 22. The inner surface of either top or bottom wall of the channel 22 is flat; while that of the other wall is provided with protuberant engaging lugs 23, which are complementary in shape with the oblong and trapezoidal through holes 14 formed in the insert portion 6. When the insert portion 6 of the pull tab proper 1 is fully inserted into the cover 2, the channel 22 and the engaging lugs 23 constitute locked surface features 21 to lock the insert portion 6 to the cover 2 against being pulled thereoff. Instead of the above-mentioned embodiment wherein one inner wall surface is flat and the other has the engaging lugs 23, the inner surfaces of both top and bottom wails of the channel 22 may be provided with engaging lugs 23.

Figure 7:
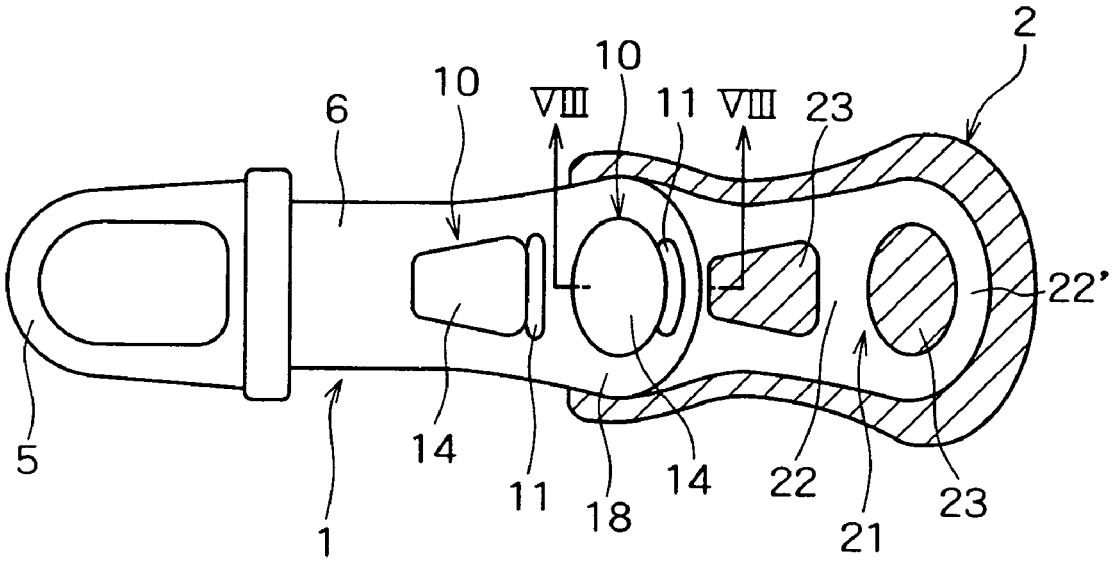
FIG. 7 is a partly cross-sectional front view showing the initial phase of the pull tab proper being inserted into the cover.
Figure 8:
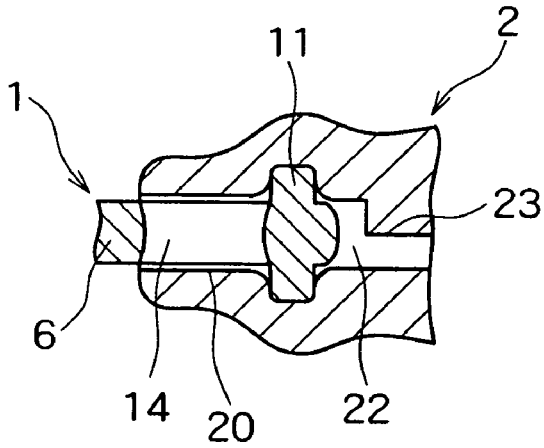
FIG. 8 is an enlarged fragmentary cross-sectional view taken on line VIII-VIII of FIG. 7.

As shown in FIGS. 7 and 8, at the initial phase of insertion, the arcuate flared portion 18 of the insert portion 6 and the projections 11 provided on the both sides of the insert portion 6 wedge through the orifice 20 into the channel 22 by gradually widening the orifice 20 through elastic deformation of the orifice 20. The insert portion 6 continues to advance into the channel 22 until the through holes 14 formed in the insert portion 6 reach the respective engaging lugs 23 of the channel 22, whereupon the engaging lugs 23 comes into fitting engagement with the corresponding through holes 14, as shown in FIGS. 9 and 10.

Figure 9:
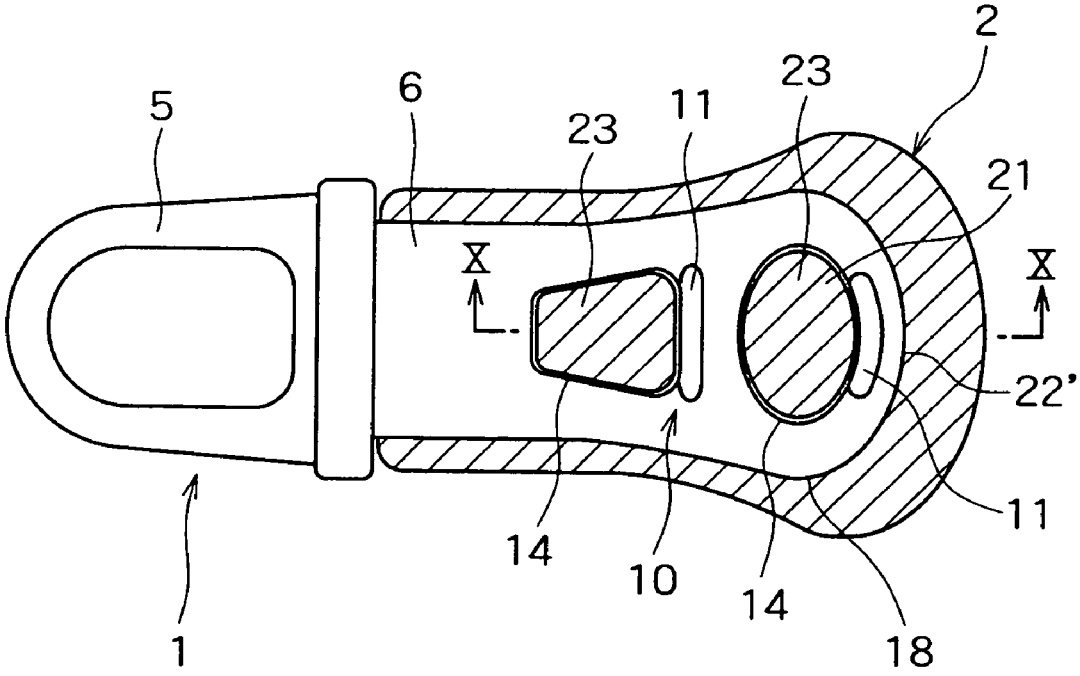
FIG. 9 is a partly cross-sectional front view showing the pull tab body having been fully inserted into the cover.
Figure 10:
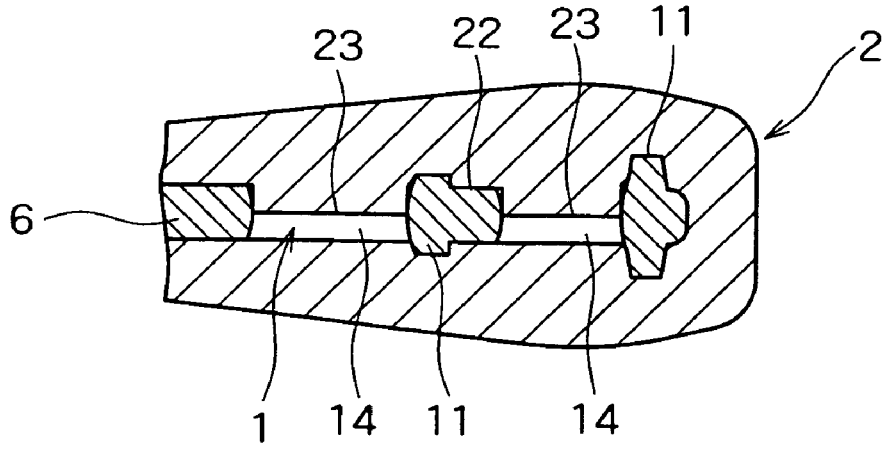
FIG. 10 is a cross-sectional view taken on line X-X of FIG. 9.
Figure 11:
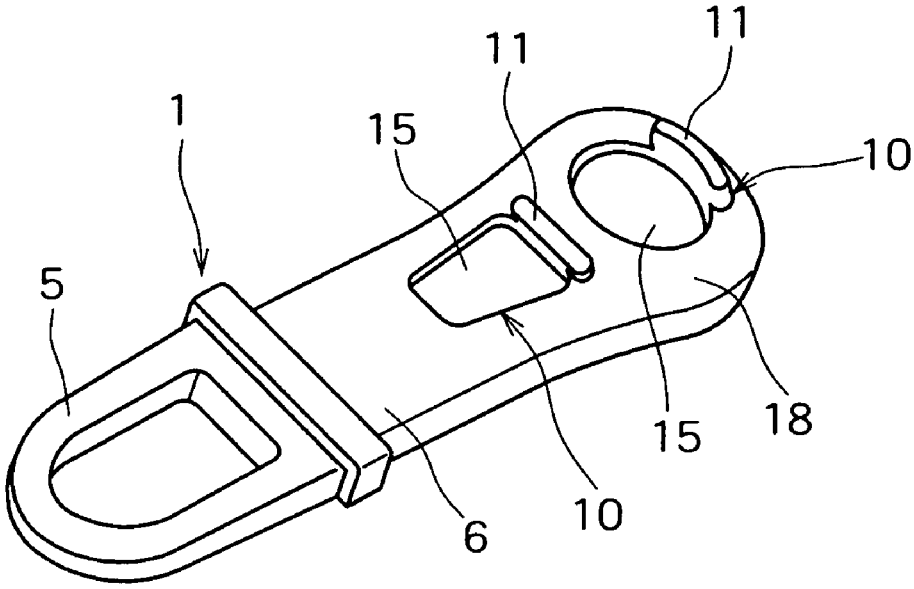
FIG. 11 is a perspective view of a pull tab proper according to the second embodiment of the present invention.
Figure 12:
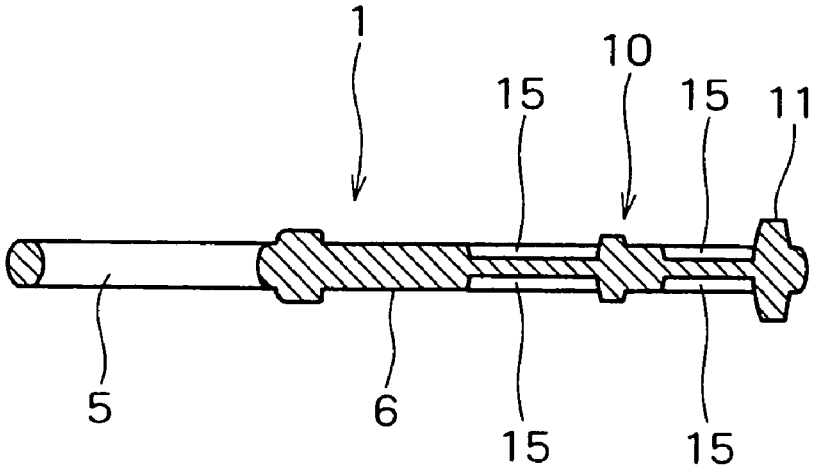
FIG. 12 is a central longitudinal cross-sectional view of the pull tab proper of FIG. 11.
Figure 13:
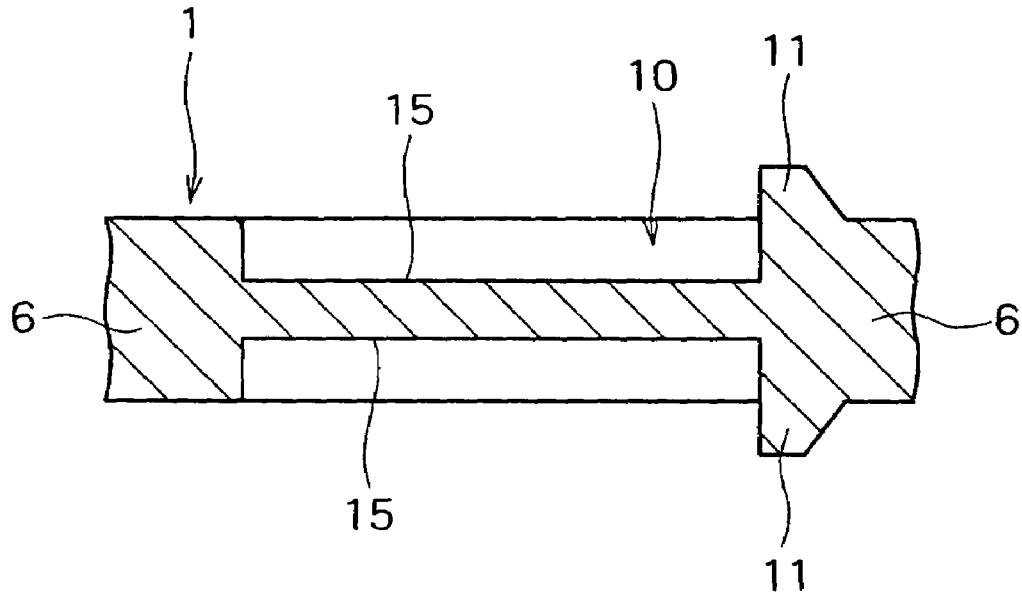
FIG. 13 is a fragmentary enlarged cross-sectional view of the pull tab proper of FIG. 12.

It is obvious from FIGS. 9 and 10 that when the insert portion 6 of the pull tab proper 1 is fully inserted into the cover 2, the oblong and trapezoidal through holes 14 of the insert portion 6 come into fitting engagement with the engaging lugs 23 of the channel 22, the insert portion 6 is resiliently housed or retained in the channel 22, the arcuate flared portion 18 is firmly enclosed by the innermost part 22' of the channel 22 and the projections 11 of the insert portion 6 press against and bite into the inside surface of the top and bottom walls of the channel 22.

As described above, in this embodiment, the locking surface features 10 comprised of the projections 11, the flared portion 18 and the through holes 14 and the locked surface features 21 comprised of the channel 22 and the engaging lugs 23 jointly function to entirely prevent the insert portion 6 of the pull tab proper 1 from being pulled off the cover 2. The through holes 14 may be circular, rectangular, triangular or of any other suitable shapes. The flared portion 18 may be rectangular, rather than being arcuate.

FIGS. 11 through 14 shows a pull tab of a slide fastener slider according to the second embodiment of the present invention. The pull tab according to the second embodiment is substantially identical with that according to the first embodiment with the following exception. In the first embodiment, the insert portion 6 has the two through holes 14 formed therethrough, one oblong and the other trapezoidal. The through holes 14 are aligned with and spaced from each other along the length of the insert portion 6.

In the second embodiment, instead of the two through holes 14, one oblong and the other trapezoidal formed through the insert portion 6, the insert portion 6 has two pairs in all of oblong and trapezoidal recesses 15 formed one pair on each side thereof, the oblong and trapezoidal recesses of both pairs formed on the upper and lower sides of the insert portion 6 being equal in their outlines and disposed in registry with each other perpendicularly of the insert portion 6. In the second embodiment, the projections 11, the flared portion 18 and the upper and lower recesses 15 of the insert potion 6 constitute the locking surface features 10.

In the first embodiment, one of both inner surfaces of the top and bottom walls of the channel 22 is flat; while the inner surface of the other wall is provided with engaging lugs 23 which are substantially complementary in shape with the oblong and trapezoidal through holes 14. In the second embodiments, both inner surfaces of the top and bottom walls of the channel 22 are provided with engaging lugs 23 functioning as a locked surface features 21. The engaging lugs 23 formed in the inner surfaces of the top and bottom walls of the channel 22 are substantially complementary in shape with the oblong and trapezoidal recesses 15 formed in the upper and lower surfaces, respectively, of the insert portion 6.

Figure 14:
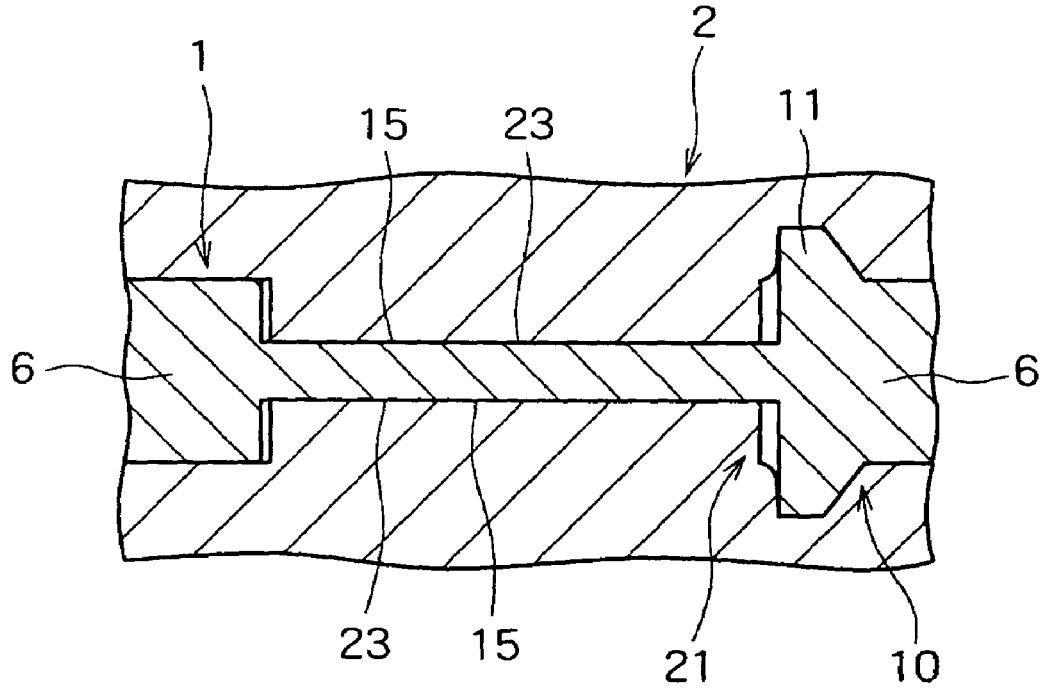
FIG. 14 is a fragmentary enlarged cross-sectional view showing the pull tab proper having fully inserted into the cover.

When the insert portion 6 of the pull tab proper 1 is fully inserted into the cover 2, the oblong and trapezoidal recesses 15 of the upper and lower sides of the insert portion 6 come into fitting engagement with the engaging lugs 23 of the top and bottom walls of the channel 22, the arcuate flared portion 18 is firmly enclosed by the innermost part 22' of the channel 22 and the projections 11 formed along the recesses 15 press against and bite into the inside surface of the top and bottom walls of the channel 22 of the cover 2, as shown in FIG. 14, so that the insert portion 6 of the pull tab proper 1 is entirely prevent from being pulled off the cover 2.

Figure 15:
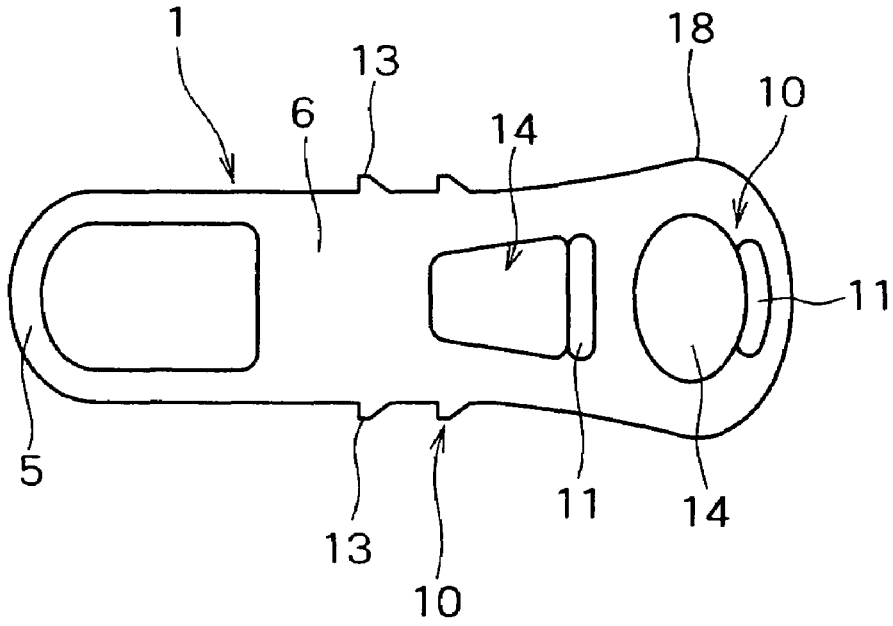
FIG. 15 is a front view of a pull tab proper according to the third embodiment of the present invention.
Figure 16:
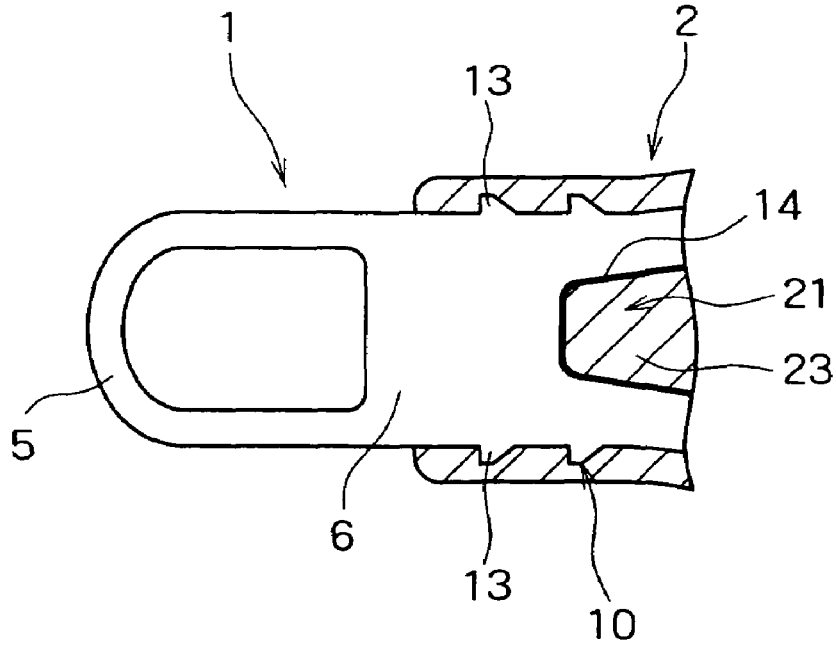
FIG. 16 is a fragmentary enlarged cross-sectional view showing the pull tab proper of FIG. 15 having been fully inserted into the cover.

FIGS. 15 and 16 show a pull tab of a slide fastener slider according to the third embodiment of the present invention. As better shown in FIG. 15, the pull tab according to the third embodiment is substantially identical with that according to the first embodiment, except that the insert portion 6 has a plurality of (two here) serrates or teeth 13, 13 formed on each side edge thereof so as to be separated from each other along the length of the insert portion 6. Each serrate 13 is substantially trapezoidal and has that side closer to the connecting link 5 formed perpendicular to the length of the pull tab proper 1 and that side closer to the flared portion 18 formed slant to the length of the pull tab proper 1. In the third embodiment, the through holes 14, the projections 11, the serrates 13 constitute the locking surface features 10.

When the insert portion 6 of the pull tab proper 1 is fully inserted into the cover 2, the oblong and trapezoidal through holes 14 of the insert portion 6 come into fitting engagement with the engaging lugs 23 of the top and bottom walls of the channel 22, the flared portion 18 is firmly enclosed by the innermost part 22' of the channel 22 and the projections 11 formed along the through openings 14 press against and bite into the inner surface of the top and bottom walls of the channel 22 of the cover 2. Furthermore, the serrates 13 press against and bite into the inside surface of the lateral walls of the channel 22 of the cover 2, so that the insert portion 6 of the pull tab proper 1 is entirely prevent from being pulled off the cover 2.

Figure 17:
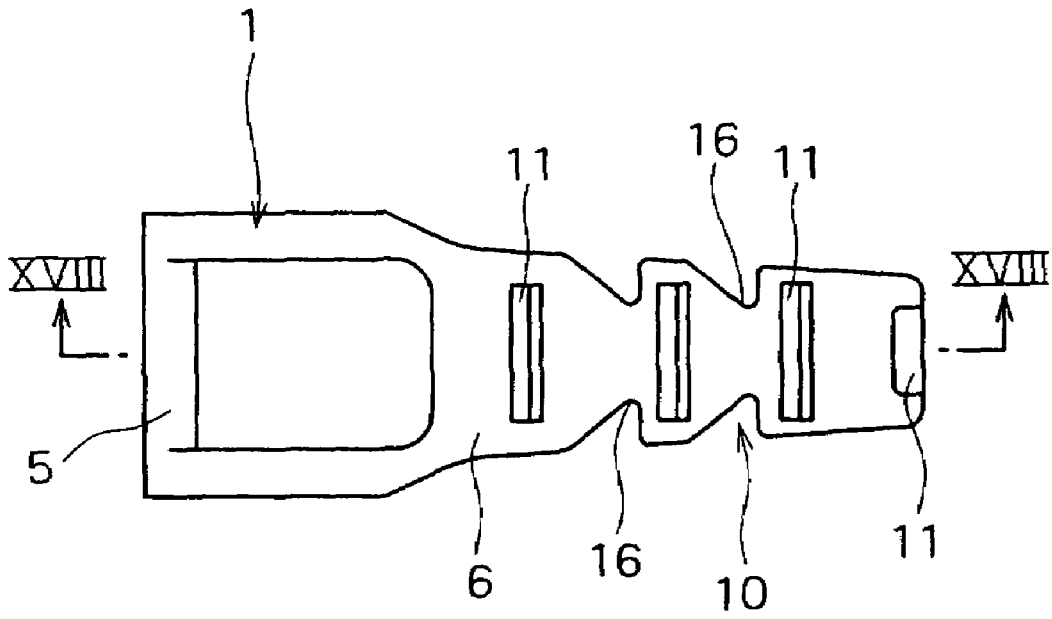
FIG. 17 is a front view of a pull tab proper according to the fourth embodiment of the present invention.
Figure 18:
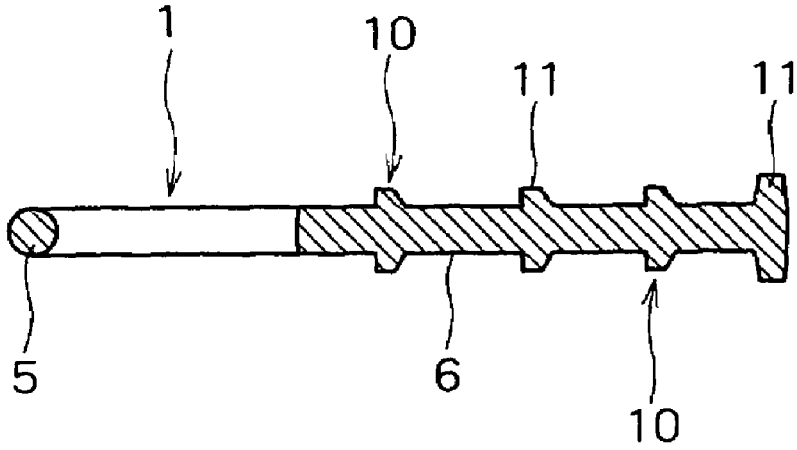
FIG. 18 is a cross-sectional view taken on line XVIII-XVIII of FIG. 17.

FIGS. 17 through 22 show a pull tab of a slide fastener slider according to the fourth embodiment of the present invention. The pull tab according to the fourth embodiment is substantially identical with that according to the first embodiment, except that the insert portion 6 slightly tapers off toward the distal end thereof and that the insert portion 6 has a plurality of serrate-like notches 16 formed along each side edge thereof and disposed in corresponding positions where those are formed along the other side edge, so that the insert portion 6 is narrowed locally or in the opposed notches 16, in other words, the insert portion 6 has alternate widened regions and narrowed regions along the length thereof. Each notch 16 is shaped like a serrate and has the side closer to the distal end of the insert portion 6 formed perpendicular to the length of the insert portion 6 and the side closer to the attaching link 5 formed slant to the length of the insert portion 6. An elongated projection 11 is formed on either upper or lower side on each widened regions of the insert portion 6, as shown in FIGS. 17 and 18.

As better shown in FIG. 18, the elongated projection 11 is of trapezoidal cross-section and has that side closer to the attaching link 5 formed perpendicular to the general plane of the insert portion 6 and that side closer to the distal end of the insert portion 6 formed slant to the general plane of the insert portion 6. In the fourth embodiment, the elongated projections 11, notches 16 constitute the locking surface features 10.

Figure 19:
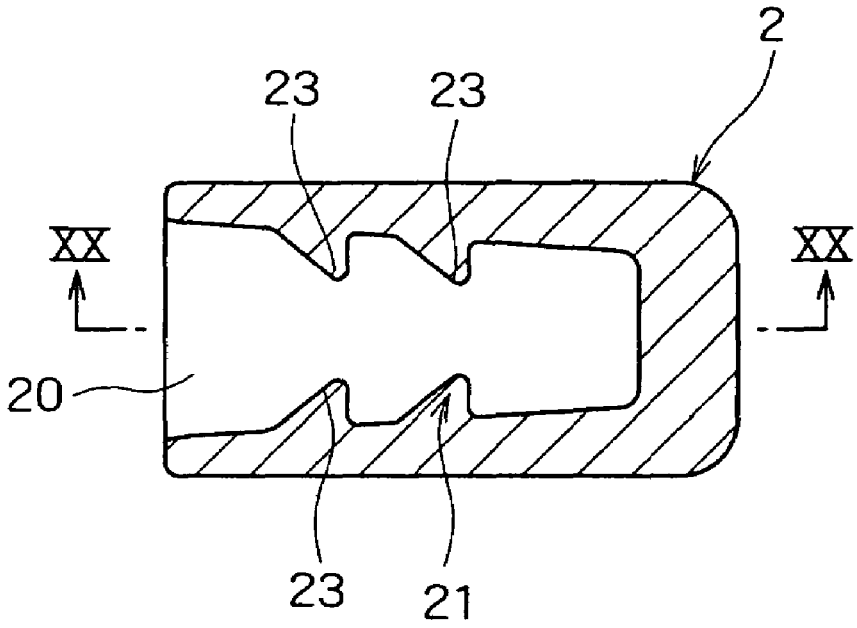
FIG. 19 is a cross-sectional view taken on line XIX-XIX of FIG. 20.
Figure 20:
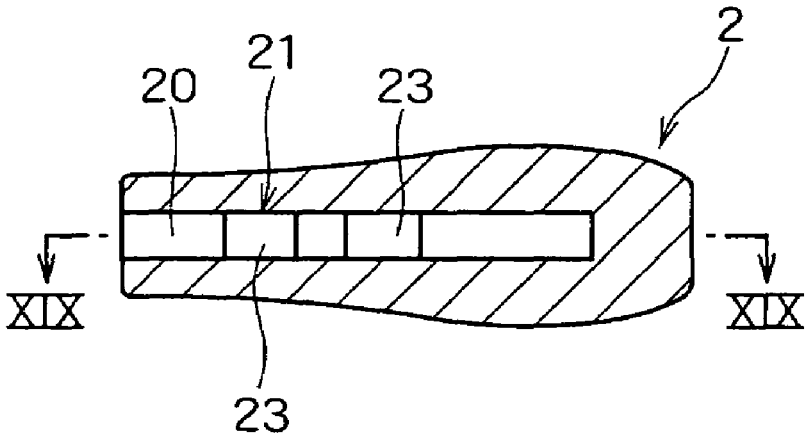
FIG. 20 is a cross-sectional view taken on line XX-XX of FIG. 19.

As shown in FIG. 19, the cover 2 is rectangular in cross-section taken along the general plane of the cover 2, is of a cigar-like shape in cross-section taken perpendicular of the general plane of the cover 2 as shown in FIG. 20. As shown in FIG. 19, the cover 2 has formed longitudinally thereof a channel 22 which is complementary in shape with the insert portion 6 of the pull tab proper 1 shown in FIG. 17. The cover 2 also has a plurality of engaging lugs 23 formed on each side wall of the channel 22 which are complementary in shape with and adapted for coming into fitting engagement with the notches 16 of the insert portion 6. The inner surfaces of the top and bottom walls of the channel 22 of the cover 2 are formed flat as shown in FIG. 20.

Figure 21:
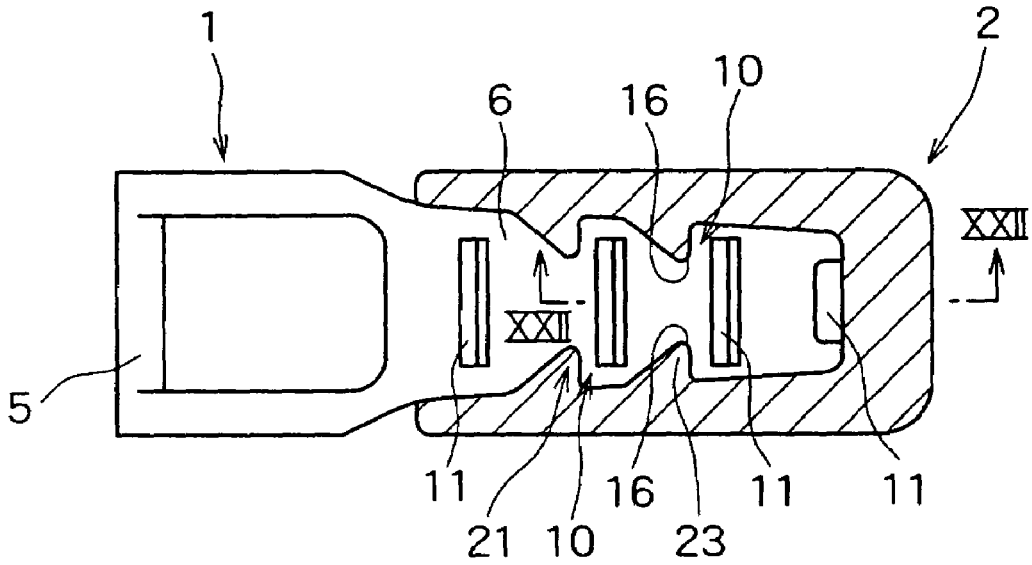
FIG. 21 is a partly cross-sectional front view showing the pull tab proper of FIG. 17 having been fully inserted into the cover.
Figure 22:
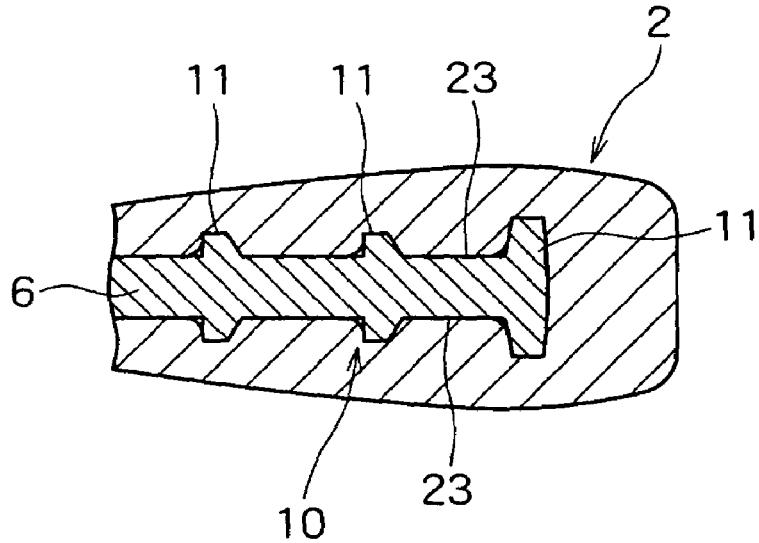
FIG. 22 is an enlarged fragmentary cross-sectional view taken on line XII-XII of FIG. 21.

For inserting the insert portion 6 of the pull tab proper 1 into the channel 22 of the cover 2, the insert portion 6 is forced through the orifice 20 through elastic deformation of the orifice 20 into the channel 22 of the cover 2 until the insert portion 6 is fully inserted into the channel 22 of the cover 2, whereupon the notches 16 of the insert portion 6 come into fitting engagement with the engaging lugs 23 as shown in FIG. 21 and the elongated projections 11 on both upper and lower sides of the insert portion 6 press against and bite into the flat inner surface of the top and bottom walls of the channel 22 of the cover 2 as shown in FIG. 22, so that the cover 2 is fully prevented from being pulled off the insert portion 6 of the pull tab proper 1.

Figure 23:
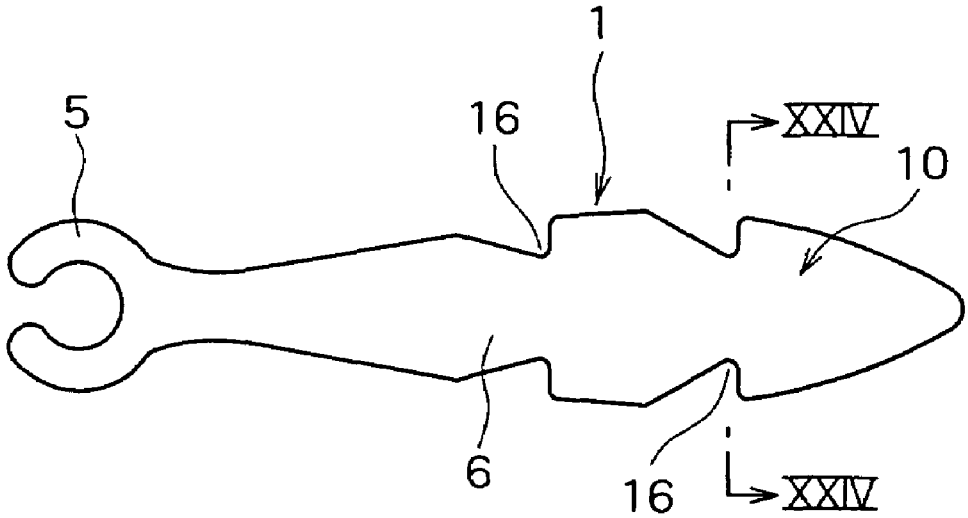
FIG. 23 is a side view of a pull tab proper according to the fifth embodiment of the present invention.
Figure 24:
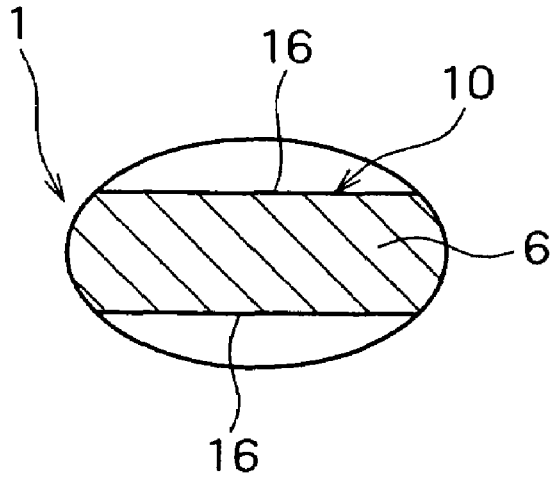
FIG. 24 is a cross-sectional view taken on line XXIV-XXIV of FIG. 23.
Figure 25:
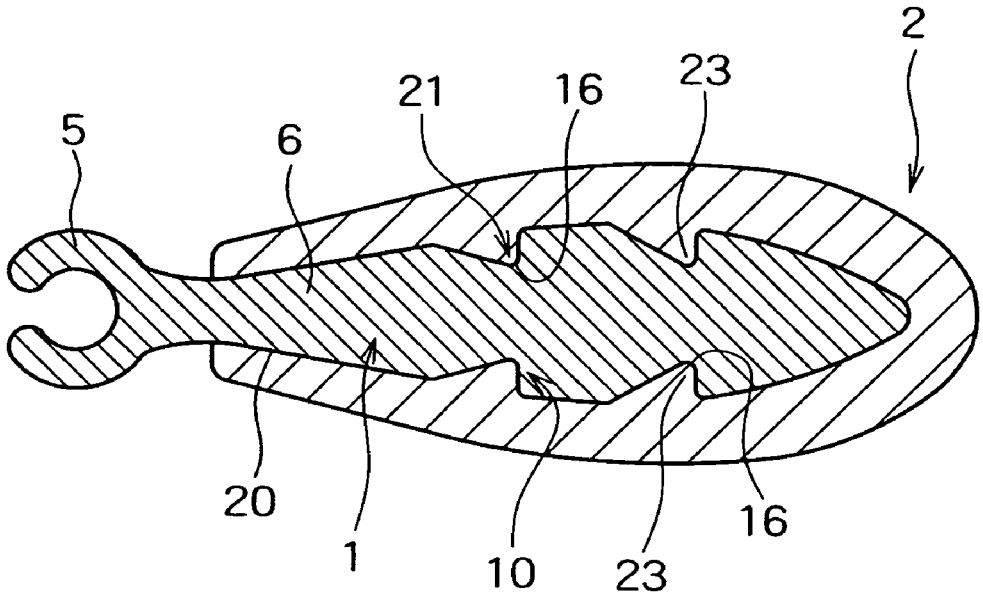
FIG. 25 is a cross-sectional view showing the pull tab proper having been fully inserted into a cover.

FIGS. 23 through 25 shows a pull tab of a slide fastener slider according to the fifth embodiment of the present invention. The pull tab according to the fifth embodiment is substantially identical with that according to the fourth embodiment shown in FIGS. 17 through 22 with the following exceptions. In the fourth embodiment, the pull tab proper 1 has an attaching portion or attaching link 5 which is ring-shaped or loop-shaped formed at its proximal end and the attaching portion 5 itself is directly connected to the pull-tab-attaching lug 31 provided on the upper surface of the slider body 30. Instead, the pull tab according to the fifth embodiment has a U-shaped clamper 5' formed at its proximal end and the U-shaped clamper 5' is adapted to clamp a connection ring (not shown) which is in turn attached to the pull-tab-attachment lug 31 on the slider body 30. The insert portion 6 of the pull tab proper 1 according to this embodiment has the shape of a flattened ellipsoid or flattened football, as shown in FIG. 23 and has an oblong cross-section as shown in FIG. 24. The streamlined insert portion 6 has a plurality of notches 16 formed on both upper and lower sides thereof. Each notch 16 has the side closer to the distal end of the insert portion 6 formed perpendicular to the general plane of the insert portion 6 and the side closer to the clamper 5' formed slant thereto.

The cover 2 has the shape of a flattened ellipsoid as well and has a channel 22 formed longitudinally thereof which channel 22 is complementary in shape with the flattened ellipsoidal insert portion 6 of the pull tab proper 1. The cover 2 has a plurality of protuberant engaging lugs 23 formed on both top and bottom walls of the channel 22 thereof.

As shown in FIG. 25, when the insert portion 6 is fully inserted into the cover 2, the notches 16 of the insert portion 6 come into fitting engagement with the protuberant engaging lugs 23 formed on the inner surfaces of the top and bottom walls of the channel 22 of the cover 2, so that the cover 2 is fully prevented from getting pulled off the insert portion 6.

Figure 26:
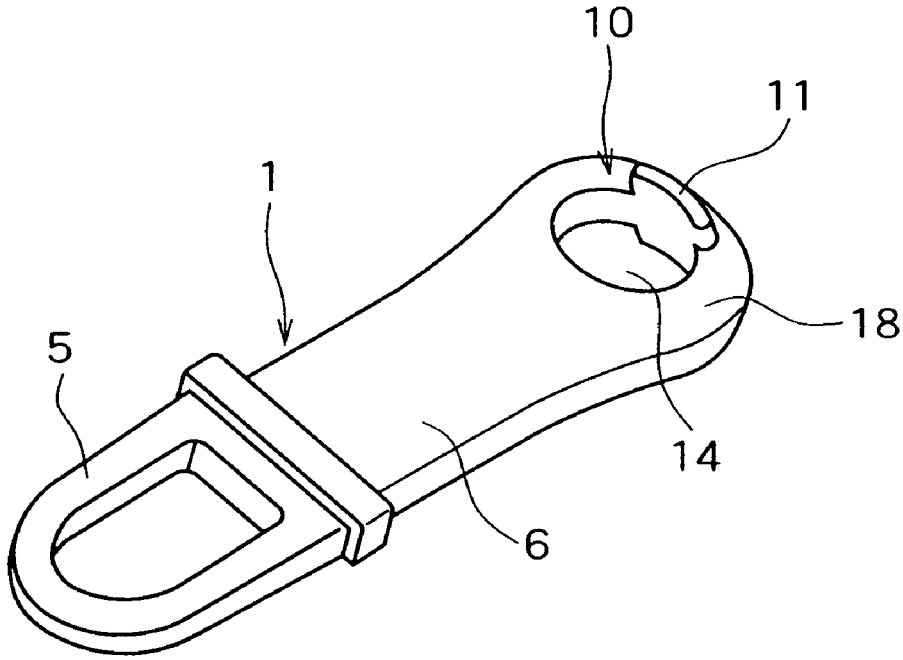
FIG. 26 is a perspective view of a pull tab proper according to the sixth embodiment of the present invention.

FIG. 26 shows a pull tab proper 1 according to the sixth embodiment of the present invention. As can be readily seen from comparison between FIGS. 2 and 26, the pull tab proper 1 according to the sixth embodiment is substantially identical with that according to the first embodiment. The only difference resides in that the pull tab proper 1 has only one through hole 14 formed through the flared end portion 18 and only one pair of projections 11 formed along the periphery of the through hole 10 one on each of the upper and lower surfaces of the insert portion 6. As readily understood although the cover 2 according to this embodiment is not shown, the cover 2 has only one protuberant engaging lug 23 formed on the inner surface of either top or bottom wall of the channel 22 thereof. The protuberant engaging lug 23 is substantially complementary in shape with the through hole 10 of the insert portion 6 of the pull tab proper 1. In this embodiment, the projections 11, the through hole 14 and the flared end portion 18 of the insert portion 6 as locking surface features 10 and the channel 22 and the protuberant engaging lugs 23 of the cover 2 as locked surface features 21 coact together to prevent the cover 2 from being pulled off the insert portion 6 of the pull tab proper 1, once the former is fully inserted into the latter.

Figure 27:
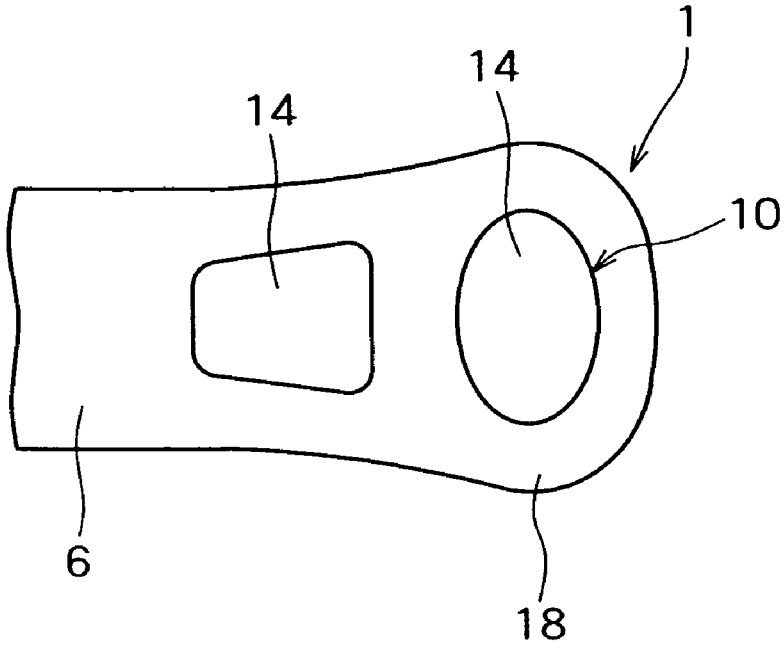
FIG. 27 is a fragmentary front view of a pull tab proper according to the seventh embodiment of the present invention.

FIG. 27 shows a pull tab proper 1 according to the seventh embodiment of the present invention. As can be readily seen from comparison between FIGS. 3 and 27, the pull tab proper 1 according to the seventh embodiment is substantially identical with that according to the first embodiment except that the pull tab proper 1 has no projections in the insert portion 6. In this embodiment, the through holes 14 and the flared end portion 18 as locking surface features 10 and the channel 22 and the protuberant engaging lugs 23 as locked surface features 21 coact together to prevent the cover 2 from being pulled off the insert portion 6 of the pull tab proper 1, when the former is fully inserted into the latter.

Figure 28:
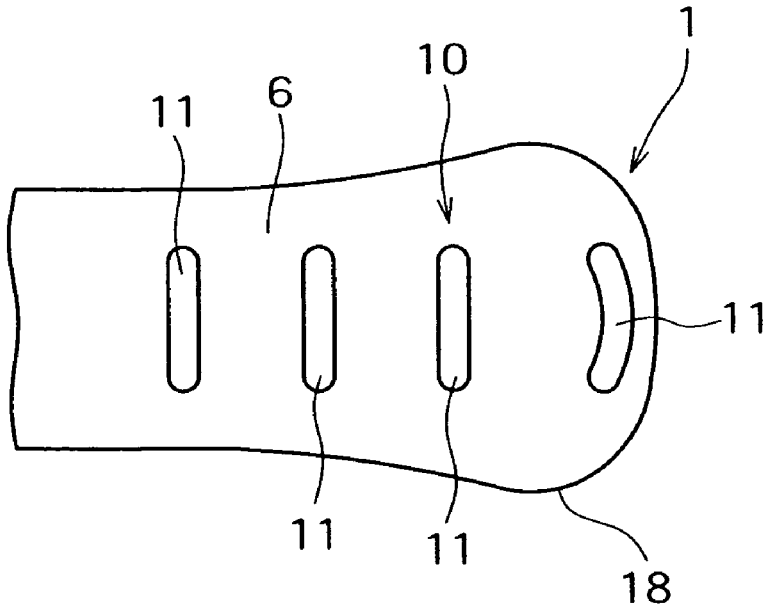
FIG. 28 is a fragmentary front view of a pull tab proper according to the eighth embodiment of the present invention.

FIG. 28 shows a pull tab proper 1 according to the eighth embodiment of the present invention. The pull tab proper 1 has a plurality of elongated projections 11 (four projections shown in FIG. 28) formed on each top and bottom side thereof, each extending laterally of the length thereof. The elongated projections 11 are disposed in spaced parallel relation to each other longitudinally of the pull tab proper 1. Each elongated projection 11 has that side closer to the attaching portion 5 formed perpendicular to the general plane of the pull tab proper 1 and that side closer to the distal end of the insert portion 6 formed slant to the general plane of pull tab proper 1. In this embodiment, the elongated projections 11 constitute the locking surface features 10 to prevent the cover 2 from being pulled off the insert portion 6 of the pull tab proper 1.

Figure 29:
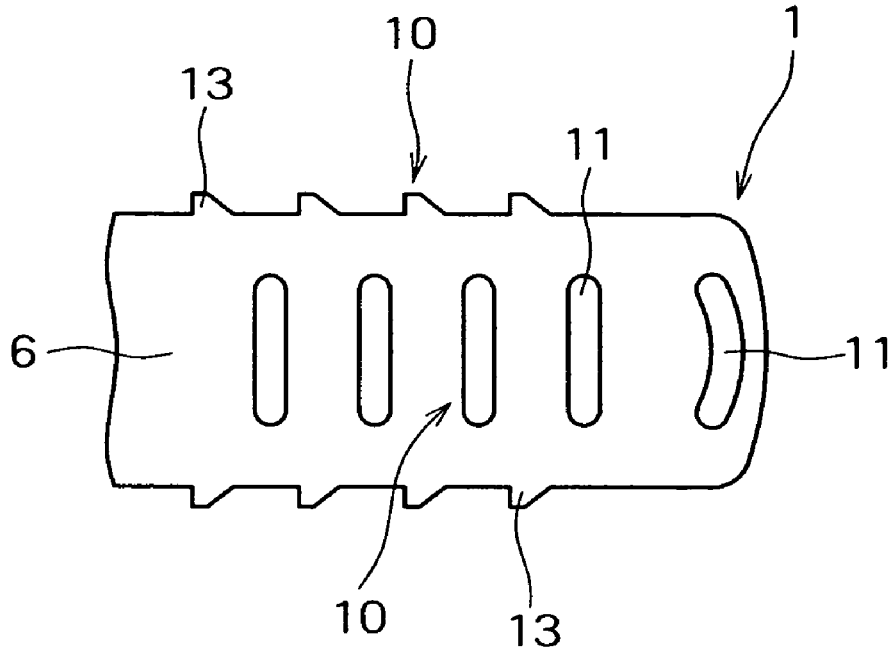
FIG. 29 is a fragmentary front view of a pull tab proper according to the ninth embodiment of the present invention.

FIG. 29 shows a pull tab proper 1 according to the ninth embodiment of the present invention. The pull tab proper 1 according to the ninth embodiment is substantially identical with that according to the eighth embodiment except that the insert portion 6 of the pull tab proper 1 has a substantially rectangular outline, that is, the insert portion 6 has no flared portion at its distal end and that, in addition to the elongated projections 11 formed on the upper and lower surfaces of the insert portion 6, the insert portion 6 has a plurality of serrates 13 formed along each side edge thereof. Each serrate 13 has that side closer to the attaching portion 5 formed perpendicularly to the length of the insert portion 6 and that side closer to the distal end of the insert portion 6 formed slant relative to the length of the insert portion 6. In this embodiment, the elongated projections 11 and the serrates 13 constitute the locking surface features 10 to prevent the cover 2 from being pulled off the insert portion 6 of the pull tab proper 1.

Figure 30:
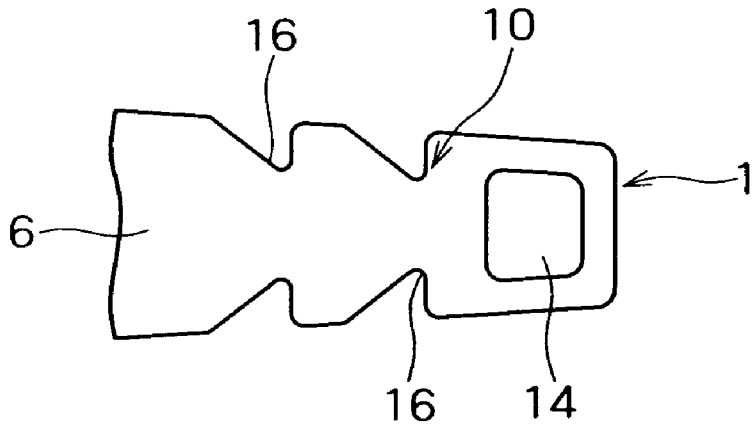
FIG. 30 is a fragmentary front view of a pull tab proper according to the tenth embodiment of the present invention.

FIG. 30 shows a pull tab proper 1 according to the tenth embodiment of the present invention. The pull tab proper 1 according to the tenth embodiment is substantially identical with that according to the fourth embodiment, except that the insert portion 6 has no elongated projections formed on either side thereof and instead the insert portion 6 has a trapezoidal through hole 14 formed in the distal end portion thereof. Although not seen in the drawings, the cover 2 has at least one protuberant engaging lug formed in the inner surface of either top or bottom side of the channel 22 thereof, which protuberant engaging lug is substantially complementary in shape with the trapezoidal through hole 14 and adapted to fitting engagement with the through hole 14. In this embodiment, the notches 16 and the through hole 14 constitute the locking surface features 10 to prevent the cover 2 from being pulled off the insert portion 6.

Figure 31:
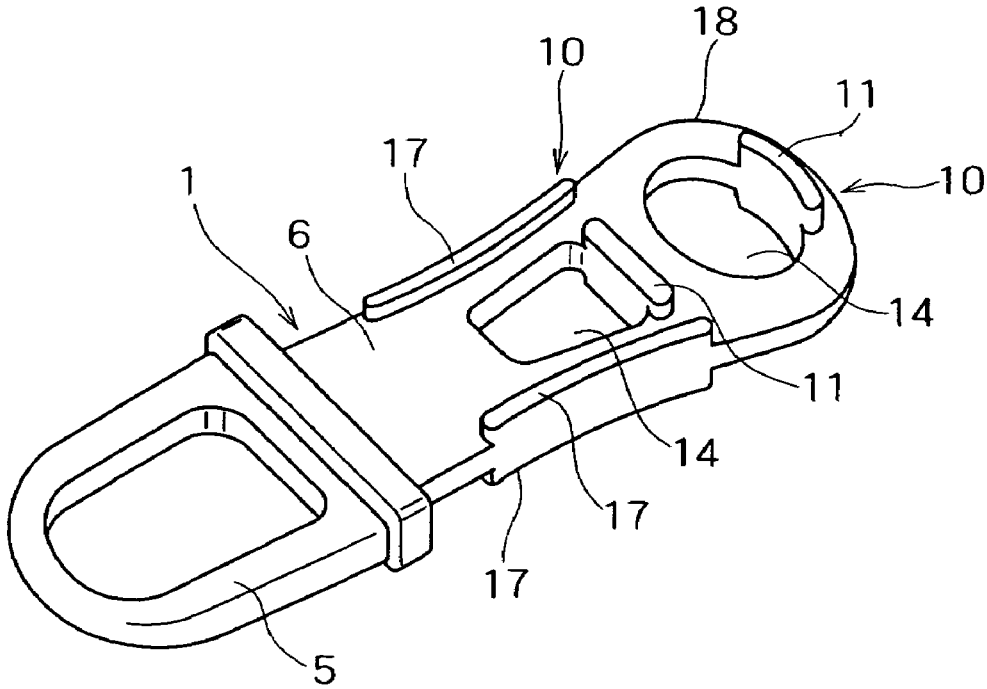
FIG. 31 is a perspective view of a pull tab proper according to the eleventh embodiment of the present invention.

FIG. 31 shows a pull tab proper 1 according to the eleventh embodiment of the present invention. The pull tab proper 1 according to the eleventh embodiment is substantially identical with that according to the first embodiment shown in FIG. 2, except that the insert portion 6 has two pairs of projecting ridges 17 extending longitudinally of the insert portion along either side edge thereof, one projecting ridge 17 of each pair formed on the upper side and the other ridge 17 on the lower side of the insert portion 6. In this embodiment, in addition to the two through holes 14, the four projections 11 and the arcuate flared portion 18, the four projecting ridges 17 constitute the locking surface features 10 to lock the insert portion 6 to the cover 2 against being pulled off therefrom when the insert portion 6 is inserted into the cover 2.

The cover 2 according to the eleventh embodiment may be substantially identical in shape with the cover 2 according to the first embodiment shown in FIGS. 5 and 6 and the cover 2 according to the second embodiment shown in FIG. 14 when the insert portion 6 is inserted into the cover 2, the projections 11 press against and bite into the inner surfaces of the top and bottom walls of the channel 22, the through holes 14 come into fitting engagement with the protuberant engaging lugs 23 formed on the inner surfaces of the top and bottom walls of the channel 22 and the flared end portion 18 is snugly wrapped by the channel 22 of the cover 2, so that the cover 2 is well prevented from being displaced in the direction of being pulled off the insert portion 6 of the pull tab proper 1. In addition, the projecting ridges 17 formed on the side edges of the insert portion 6 press against the inner surfaces of both top and bottom walls of the channel 22 of the cover 2, so that the cover 2 is well prevented from being rotated relative to the pull tab proper 1 even if severe stresses are exerted tending to distort the pull tab proper 1. The locking surface features 10 of the pull tab proper 1 according to the eleventh embodiment advantageously functions not only to prevent the cover 2 from being pulled off the pull tab proper 1 but also to prevent the cover 2 from being rotated relative to the pull tab proper 1.

Figure 32:
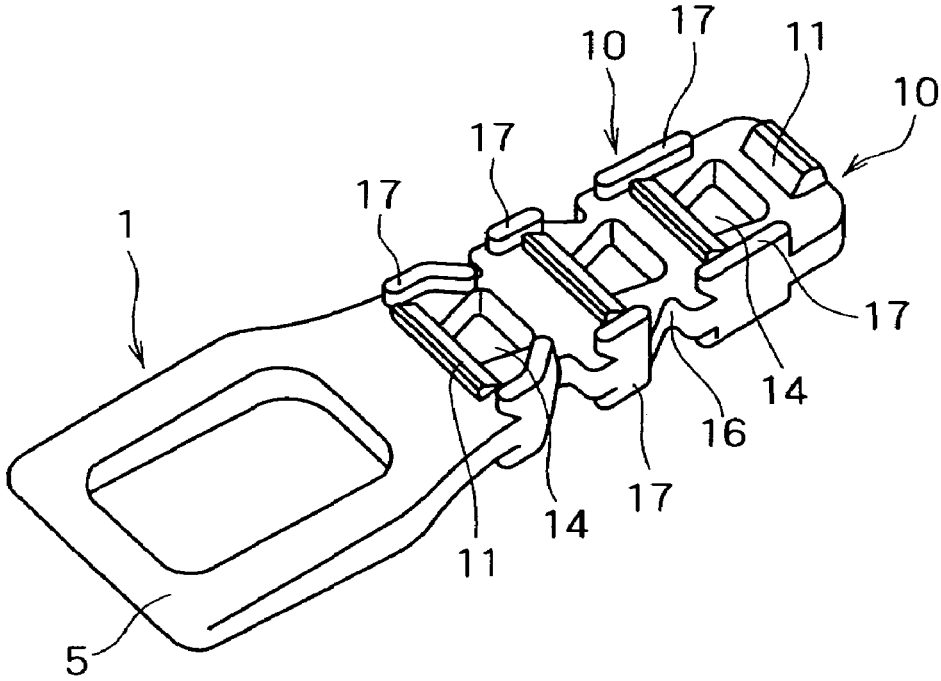
FIG. 32 is a perspective view of a pull tab proper according to the twelfth embodiment of the present invention.
Figure 33:
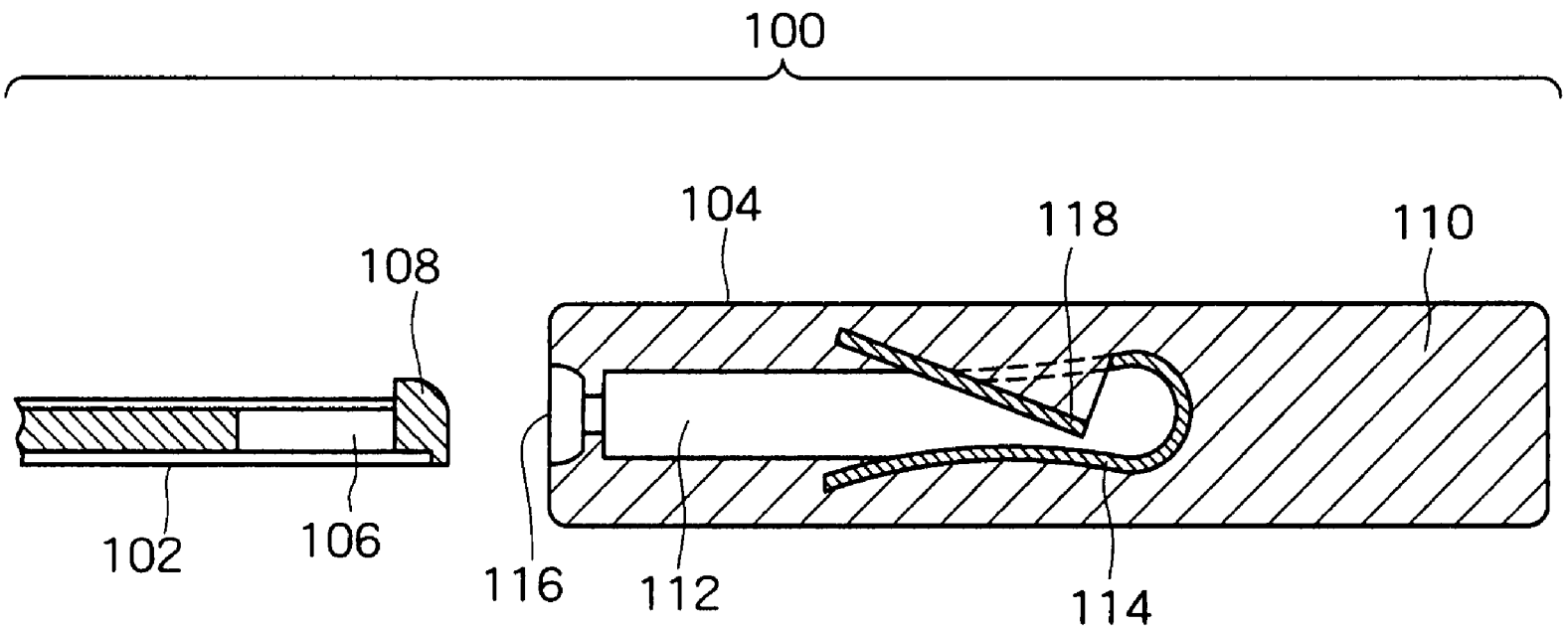
FIG. 33 is a cross-sectional view of a pull tab according to a related art, showing that the pull tab proper is disposed in alignment with a cover, ready for insertion thereinto.
Figure 34:
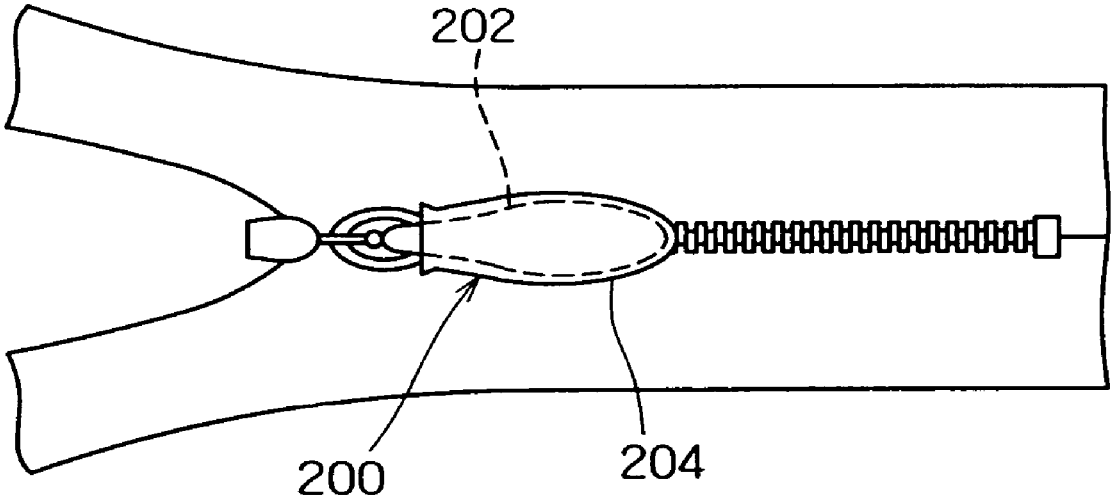
FIG. 34 is a front view of a slider wherein a pull tab according to another related art is shown.

FIG. 32 shows a pull tab proper 1 according to the twelfth embodiment of the present invention. The pull tab proper 1 according to the twelfth embodiment is substantially identical with that according to the fourth embodiment shown in FIG. 17, except that the insert portion 6 according to the twelfth embodiment further has a plurality of (three here) trapezoidal through holes 14 formed therethrough beside the respective elongated projections 11 except the one formed at the distal end of the insert portion 6 and the trapezoidal through holes 14 are disposed between the opposed notches 16 formed in the opposed side edges of the insert portion 6 and that a plurality of projecting ridges 17 are provided on both top and bottom side of the insert portion 6, along each side edge substantially except for the notches 16. In this embodiment, the trapezoidal through holes 14, the elongated projections 11, the projecting ridges 17 and the side notches 16 constitute the locking surface features 10 to prevent the cover 2 from being pulled off from the insert portion 6 once the insert portion 6 is inserted into the cover 2.

Although not shown, the cover according to the twelfth embodiment substantially identical with that according to the fourth embodiment shown in FIGS. 19 and 20, except that the cover 2 according to the twelfth embodiment has a plurality of protuberant engaging lugs 23 formed on the inner surface of either one of or both top and bottom walls of the channel 22 of the cover 2, which protuberant engaging lugs 23 are substantially complementary in shape with and adapted to come into fitting engagement with the trapezoidal through holes 14 of the insert portion 6 of the pull tab proper 1.

Once the insert portion 6 is fully inserted into the channel 22 of the cover 2, the notches 16 of the insert portion 6 come into fitting engagement with the protuberant engaging lugs 23 formed on the side edges of the channel 22 and the elongated projections 11 on both upper and lower sides of the insert portion 6 press against and bite into the flat inner surfaces of both top and bottom walls of the channel 22 of the cover 2, and in addition, the trapezoidal through holes 14 of the insert portion 2 comes into fitting engagement with the protuberant engaging lugs 23 formed on the inner surface of either or both of the top and bottom walls of the channel 22 so that the cover 2 is well prevented from being pulled off the insert portion 6 of the pull tab proper 1. Furthermore, the projecting ridges 17 formed along both side edges of the insert portion 6 press against and bite into the flat inner surface of the top and bottom walls of the channel 22 of the cover 2, so that the cover 2 is well prevented from being rotated relative to the pull tab proper 1 even if severe stresses are exerted tending to distort the pull tab proper 1. The locking surface features 10 of the pull tab proper 1 according to the twelfth embodiment also advantageously functions not only to prevent the cover 2 from being pulled off the pull tab proper 1 but also to prevent the cover 2 from being rotated relative to the pull tab proper 1.

As explained hereinbefore, the locking surfaces features may include any combination of two or more locking surface features that are different in forms from each other, such as the through holes, the projections, the projecting ridges and the side notches.

In the above-mentioned embodiments, it has been said that the projections 11 and the projecting ridges 17 of the insert portion 6 press against and bite into the flat inner surface of the top and lower walls of the channel 22 of the cover 2, through elastic deformation of the cover 2. However, rather than being flat, the inner surface of the top and bottom walls of the channel 22 of the cover 2 may be provided in its corresponding positions with relevant grooves to facilitating the biting into the cover 2 by the projections 11 and projecting ridges 17 of the insert portion 6.

Conclusions, Ramifications, and Scope:

According to the present invention, once the cover is fully inserted into the pull tab proper, the locking surface features advantageously function to prevent the cover from being pulled off the pull tab proper.

Furthermore, the pull tab according to the invention is comprised of only a pull tab proper and a cover, the pull tab proper having the locking surface features formed in itself. Therefore, this pull tab is simple in construction. No extra part is needed to produce this pull tab. No extra labor and time is thus needed.

The pull tab of the slide fastener slider according to the present invention described hereinbefore finds a wide application to pothole types of clothing, and particularly clothing for infants and aged people, and further to bugs, cases and shoes, or the like.

Although the description above contains many specificities, these should not be construed as limiting the scope of the invention but as merely providing illustrations of some of the presently preferred embodiments of this invention.

Thus, the scope of the invention should be determined by the appended claims and their legal equivalents, rather than by the examples given.

What is claimed is:

1. A pull tab of a slide fastener slider, comprising:

a pull tab having an insert portion and a slider-attaching portion provided at a proximal end of the insert portion for attachment to the slider, the insert portion and the slider-attaching portion being integral with each other forming a one-piece structure; and a cover made of flexible material and having an open end and a closed opposite end, the cover adapted to have the insert portion inserted thereinto and cover substantially all of the insert portion, the insert portion including a plurality of locking surface features for preventing the cover from being pulled off the insert portion, wherein the locking surface features comprise:

a through hole formed through the insert portion, and a serrate formed on a side edge of the insert portion, and wherein the cover further comprises a channel formed therein for housing the insert portion of the pull tab and a plurality of locked surface features formed in the inner surface of the channel and adapted to be locked by the locking surface features, the inner surface of the channel being provided with a protuberant engaging lug which is complementary in shape with the through hole, the channel and the engaging lug constituting a locked surface to lock the insert portion to the cover against being pulled thereoff.

2. A pull tab of a slide fastener slider according to claim 1, wherein the locking surface features further comprise a projection formed on a surface of the insert portion.

3. A pull tab of a slide fastener slider according to claim 2, wherein the projection is elongate and extends laterally of the length of the insert portion.

4. A pull tab of a slide fastener slider according to claim 1, wherein the open end of the cover has an orifice that widens by elastic deformation of the cover when the insert portion is inserted through the orifice into the cover.

5. A pull tab of a slide fastener slider, comprising:

a pull tab having an insert portion and a slider-attaching portion provided at a proximal end of the insert portion for attachment to the slider, the insert portion and the slider-attaching portion being integral with each other forming a one-piece structure; and a cover made of flexible material and having an open end and a closed opposite end, the cover adapted to have the insert portion inserted thereinto and cover substantially all of the insert portion, the insert portion including a plurality of locking surface features for preventing the cover from being pulled off the insert portion, wherein the locking surface features comprise:

a notch formed in a side edge of the insert portion, a through hole formed through the insert portion, and an elongate projection formed on a surface of the insert portion and extending laterally of the length of the insert portion, and wherein the cover further comprises a channel formed therein for housing the insert portion of the pull tab and a plurality of locked surface features formed in the inner surface of the channel and adapted to be locked by the locking surface features, the inner surface of the channel being provided with a protuberant engaging lug which is complementary in shape with the through hole, the channel and the engaging lug constituting a locked surface to lock the insert portion to the cover against being pulled thereoff.

6. A pull tab of a slide fastener slider according to claim 5, wherein the open end of the cover has an orifice that widens by elastic deformation of the cover when the insert portion is inserted through the orifice into the cover.

* * * * *

UNITED STATES PATENT AND TRADEMARK OFFICE

CERTIFICATE OF CORRECTION

PATENT NO. : 7,574,783 B2
APPLICATION NO. : 10/919677
DATED : August 18, 2009
INVENTOR(S) : Muratsubaki et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 0 days.

Signed and Sealed this

Seventh Day of September, 2010

David J. Kappos

David J. Kappos
*Director of the United States Patent and Trademark Office*